US010087644B2

(12) United States Patent
Lin et al.

(10) Patent No.: US 10,087,644 B2
(45) Date of Patent: Oct. 2, 2018

(54) WATER SPRAYING DEVICE FOR INFLATABLE POOL

(71) Applicant: Intex Marketing Ltd., Tortola (VG)

(72) Inventors: Hua Hsiang Lin, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 15/247,468

(22) Filed: Aug. 25, 2016

(65) Prior Publication Data

US 2017/0058544 A1 Mar. 2, 2017

(30) Foreign Application Priority Data

Aug. 26, 2015 (CN) ..... 2015 2 0650954 U

(51) Int. Cl.

| | |
|---|---|
| ***E04H 4/12*** | (2006.01) |
| ***A61H 33/00*** | (2006.01) |
| ***E04H 4/00*** | (2006.01) |
| ***A61H 33/02*** | (2006.01) |
| ***B05B 1/00*** | (2006.01) |

(52) U.S. Cl.

CPC ..... *E04H 4/12* (2013.01); *A61H 33/6005* (2013.01); *B05B 1/00* (2013.01); *E04H 4/0025* (2013.01); *A61H 33/02* (2013.01); *A61H 33/027* (2013.01); *A61H 2033/021* (2013.01); *A61H 2201/0103* (2013.01)

(58) Field of Classification Search

CPC ..... E04H 4/0025; A61H 33/6063

See application file for complete search history.

(56) References Cited

U.S. PATENT DOCUMENTS

| | | | |
|---|---|---|---|
| 3,677,474 | A | 7/1972 | Lorenzen |
| 4,168,705 | A | 9/1979 | Raab |
| 4,637,080 | A | 1/1987 | Hutchinson |
| 4,928,885 | A | 5/1990 | Nakao |
| 5,058,220 | A | 10/1991 | Mikiya |
| 5,279,003 | A | 1/1994 | Gape et al. |
| 5,495,627 | A | 3/1996 | Leaverton et al. |
| D376,432 | S | 12/1996 | Bartlett et al. |
| D389,245 | S | 1/1998 | Lopez |
| 5,754,989 | A | 5/1998 | Ludlow |
| 5,801,262 | A | 9/1998 | Ton |
| 5,809,648 | A | 9/1998 | Kurth et al. |
| 5,920,924 | A | 7/1999 | Pinciaro |
| 5,978,982 | A | 11/1999 | Leeuwerik |

(Continued)

FOREIGN PATENT DOCUMENTS

| | | | |
|---|---|---|---|
| EP | 1 138 307 | A2 | 7/2008 |
| WO | 2015/085227 | A1 | 6/2015 |

OTHER PUBLICATIONS

Search Report dated Jan. 4, 2017 in European Application No. 16186055.6.

*Primary Examiner* — Janie Loeppke

(74) *Attorney, Agent, or Firm* — Faegre Baker Daniels LLP

(57) ABSTRACT

A sprayer configured to provide an air-water mixture to a pool or spa. The sprayer includes an outlet module for spraying an air-water mixture into a water cavity of the pool, a suction module for suctioning ambient air into the outlet module, and a connecting pipe that connects the outlet module and the suction module. The sprayer may be concealed within an inflatable chamber of the pool.

20 Claims, 6 Drawing Sheets

(56) References Cited

U.S. PATENT DOCUMENTS

| | | | | |
|---|---|---|---|---|
| 5,983,417 | A | 11/1999 | Perdreau et al. | |
| 5,987,663 | A | 11/1999 | Ludlow et al. | |
| 6,000,073 | A | 12/1999 | Eddington | |
| 6,092,246 | A | 7/2000 | Ludlow | |
| 6,123,274 | A | 9/2000 | Perdreau et al. | |
| 6,141,804 | A | 11/2000 | Pinciaro | |
| 6,256,805 | B1 | 7/2001 | Ludlow et al. | |
| 6,264,122 | B1 | 7/2001 | Perdreau et al. | |
| 6,334,224 | B1 | 1/2002 | Chalberg et al. | |
| 6,357,059 | B1 | 3/2002 | Lau | |
| 6,491,238 | B1 | 12/2002 | Swanson et al. | |
| 6,510,277 | B1 | 1/2003 | Dongo | |
| 6,543,067 | B2 | 4/2003 | Eddington et al. | |
| 6,745,413 | B2 | 6/2004 | Pinciaro | |
| 7,493,665 | B2 * | 2/2009 | Williams | A61H 33/027 4/492 |
| 7,644,452 | B2 | 1/2010 | Colin | |
| 7,743,437 | B2 | 6/2010 | Reynoso | |
| 7,849,529 | B2 | 12/2010 | Bedard | |
| 7,908,684 | B2 | 3/2011 | Ludlow | |
| 7,950,077 | B2 | 5/2011 | Santamarina et al. | |
| 8,108,954 | B2 * | 2/2012 | Lau | A61H 33/02 4/541.1 |
| 8,661,576 | B2 | 3/2014 | Ludlow et al. | |
| 8,869,320 | B1 | 10/2014 | Santamarina et al. | |
| 2002/0029414 | A1 * | 3/2002 | Shun Lau | A61H 33/0087 4/541.1 |
| 2003/0089797 | A1 | 5/2003 | Buck | |
| 2004/0194203 | A1 | 10/2004 | Pinciaro | |
| 2006/0260038 | A1 | 11/2006 | Lau | |
| 2007/0079433 | A1 | 4/2007 | Juneau et al. | |
| 2007/0124855 | A1 | 6/2007 | Lau | |
| 2007/0192952 | A1 | 8/2007 | Lau | |
| 2007/0226892 | A1 | 10/2007 | Strickland et al. | |
| 2008/0134425 | A1 | 6/2008 | Tatum | |
| 2009/0242047 | A1 | 10/2009 | Hilton et al. | |
| 2012/0005819 | A1 | 1/2012 | Yuhas et al. | |
| 2012/0124732 | A1 | 5/2012 | Lau | |
| 2014/0131472 | A1 | 5/2014 | Eddington | |
| 2015/0020306 | A1 | 1/2015 | Lin et al. | |

* cited by examiner

WATER SPRAYING DEVICE FOR INFLATABLE POOL

CROSS REFERENCE TO RELATED APPLICATION

This application claims priority to Chinese Patent Application Serial No. 201520650954.7, filed Aug. 26, 2015, the disclosure of which is hereby expressly incorporated by reference herein in its entirety.

FIELD OF THE DISCLOSURE

The present disclosure relates to a pool sprayer and to an inflatable water pool with the pool sprayer.

BACKGROUND OF THE DISCLOSURE

Sprayers are not only used to add water to a water pool or spa, but are also used for massage and relaxation. Depending on each user's personal preference and other factors, existing sprayers may spray water into the pool with a strong force that is uncomfortable against the user's skin, or with a weak force that is insufficient to achieve a massaging effect.

SUMMARY

The present disclosure provides a pool sprayer with the capability of providing an air-water mixture to the pool, if desired. The pool sprayer includes an outlet module for spraying water into the recess of the pool, a suction module for suctioning ambient air into the outlet module, and a connecting pipe that connects the outlet module and the suction module.

According to an embodiment of the present disclosure, a inflatable pool assembly is provided. The inflatable pool assembly includes: an inner wall defining a water cavity; an outer wall cooperating with the inner wall to define an inflatable chamber; a plurality of water sprayers spaced around the water cavity, each of the plurality of water sprayers comprising: a suction module positioned at least partially within the inflatable chamber and having an air inlet positioned at the outer wall; an outlet module positioned at least partially within the inflatable chamber and having a mixed outlet positioned at the inner wall, wherein the mixed outlet is in fluid communication with the air inlet and a water inlet; and a connecting pipe between the suction module and the outlet module.

According to another embodiment of the present disclosure, the inflatable pool assembly includes: an inner wall defining a water cavity; an outer wall cooperating with the inner wall to define an inflatable chamber; a plurality of water sprayers, each of the plurality of water sprayers comprising: an outlet module positioned at least partially within the inflatable chamber and having a mixed outlet positioned at the inner wall, the mixed outlet is in fluid communication with an air inlet and a water inlet; and a suction module positioned vertically above the outlet module and at least partially within the inflatable chamber, the suction module having the air inlet positioned at the outer wall; a connecting pipe between the suction module and the outlet module.

According to yet another embodiment of the present disclosure, a method for manufacturing an inflatable pool assembly is provided. The method of manufacture includes: coupling an inner wall to an outer wall to define an inflatable chamber; coupling a portion of a suction module to the outer wall, the suction module positioned at least partially within the inflatable chamber; coupling a portion of an outlet module to the inner wall, the outlet module positioned at least partially within the inflatable chamber; and coupling the outlet module and the suction module together by a connecting pipe.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
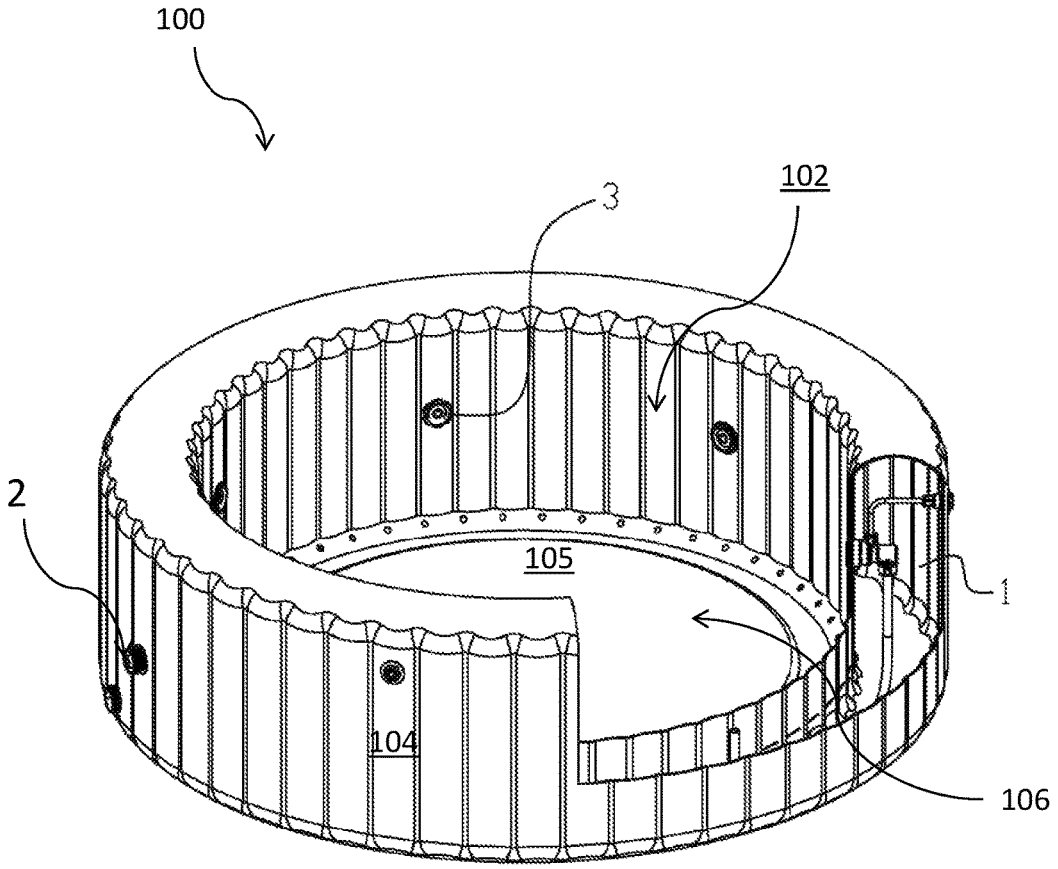
FIG. 1 is a perspective view of an inflatable pool assembly of the present disclosure with a partial cut-away showing a pool sprayer.
Figure 2:
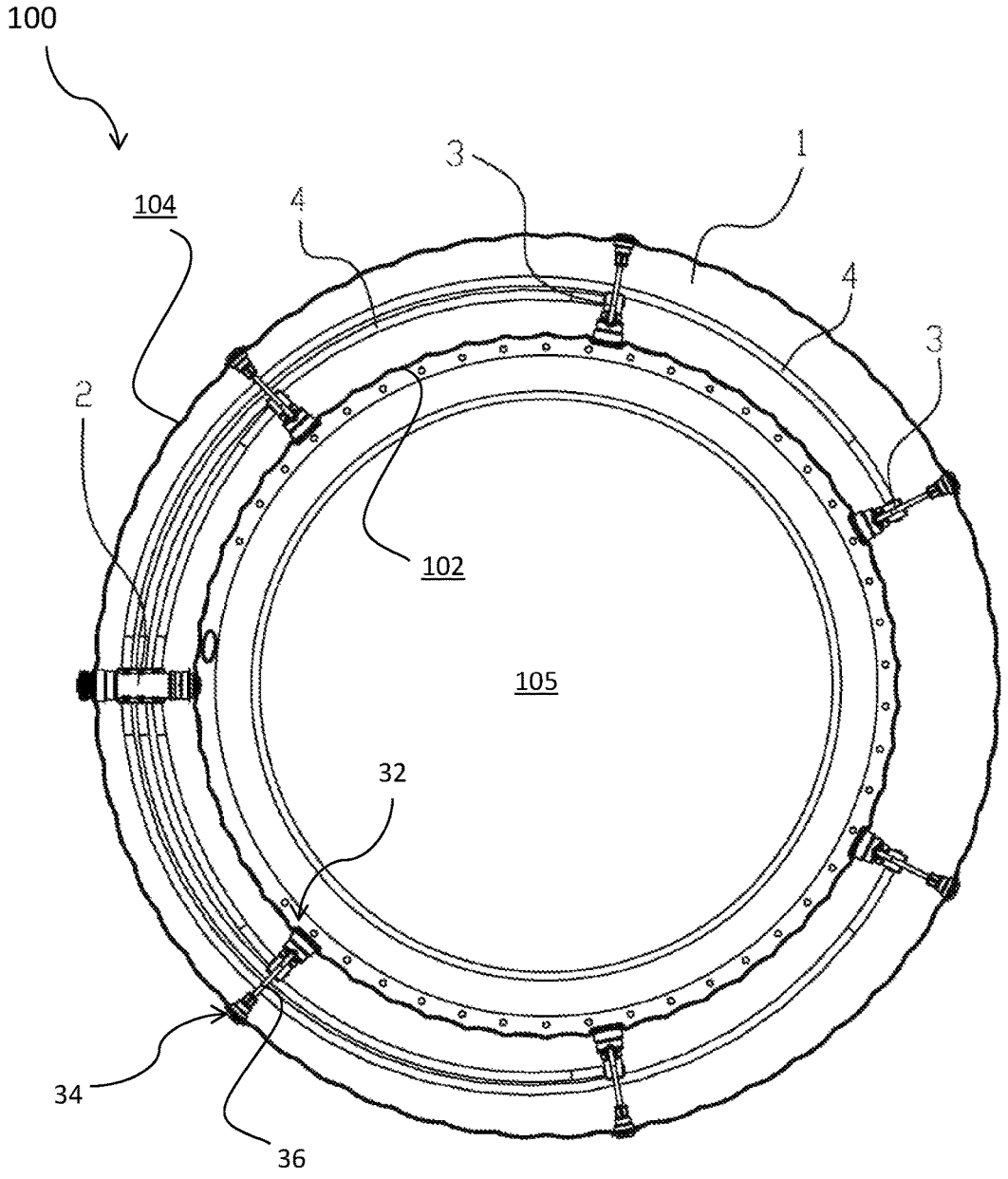
FIG. 2 is a top, cross-sectional view of the inflatable pool assembly of FIG. 1 showing the pool sprayer.
Figure 3:
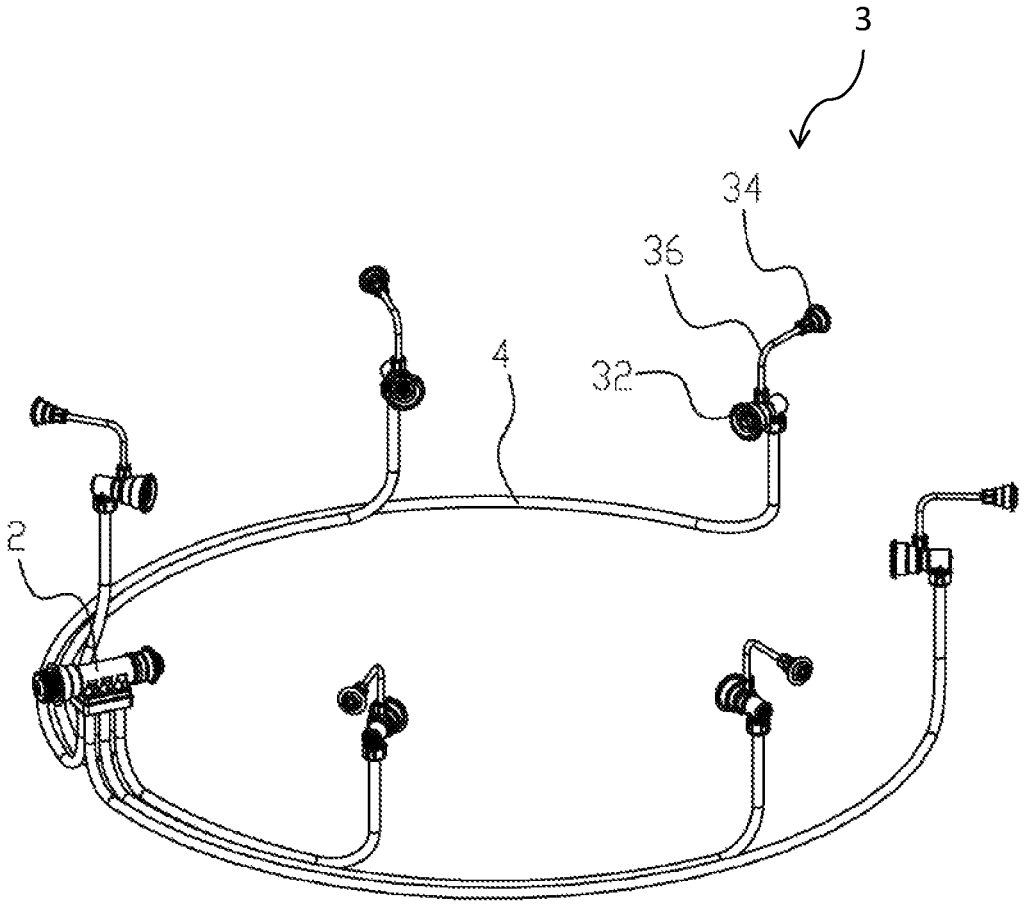
FIG. 3 is a perspective view of the pool sprayer of FIG. 1.

Referring to FIGS. 1-3, an inflatable pool or spa assembly 100 is shown. The inflatable pool assembly 100 comprises an inner wall 102 and an outer wall 104 that are coupled together to define an inflatable chamber 1 therebetween. The inflatable pool assembly 100 also comprises a floor 105 that cooperates with inner wall 102 to define an internal cavity or recess 106 that is configured to hold water for swimming and/or bathing.

The inflatable pool assembly 100 further comprises a plurality of pool sprayers 3 spaced around the water recess 106. The illustrative inflatable pool assembly 100 comprises six pool sprayers 3, although this number may vary. Each pool sprayer 3 can be operated independently to control the outlet flow volume of each pool sprayer 3.

Inflatable chamber 1 houses each pool sprayer 3. Each pool sprayer 3 includes an outlet module 32 coupled to inner wall 102, a suction module 34 coupled to outer wall 104, and an L-shaped connecting pipe 36 between the outlet module 32 and the suction module 36 that resides at least partially within inflatable chamber 1. Along inner wall 102, inner-most portions of pool sprayer 3, described in further detail below, may extend inwardly from inner wall 102, towards inner recess 106. Along outer wall 104, outer-most portions of pool sprayer 3, described in further detail below, may extend outwardly from outer wall 104, away from inner recess 106.

Inflatable chamber 1 also includes one or more annular, flexible pipes 4 (e.g., hoses) which connect each outlet module 32 to inlet valve 2 as described in further detail below. In the illustrative embodiment, each pool sprayer 3 is associated with its own pipe 4, so there are six pool sprayers 3 and six corresponding pipes 4, although these numbers may vary.

Inlet valve 2 extends entirely through inflatable pool assembly 100 from outer wall 104, through inflatable chamber 1, and through inner wall 102 where a portion of inlet valve 2 extends into inner recess 106. Inlet valve 2 is configured to connect to an external water source, such as a residential water hose or another water reservoir (not shown), and may direct water directly into inner recess 106 of inflatable pool assembly 100.

Inlet valve 2 may also indirectly provide water into inner recess 106 of inflatable pool assembly 100 through pipes 4 and outlet modules 32 of pool sprayers 3. In the illustrative embodiment of FIGS. 1 and 3, inlet valve 2 receives water from the external water source (not shown) and directs water through each pipe 4 connected to inlet valve 2. The water then moves through outlet module 32 of each pool sprayer 3 where outlet module 32 delivers the water to inner recess 106 as described in further detail below.

Figure 4:
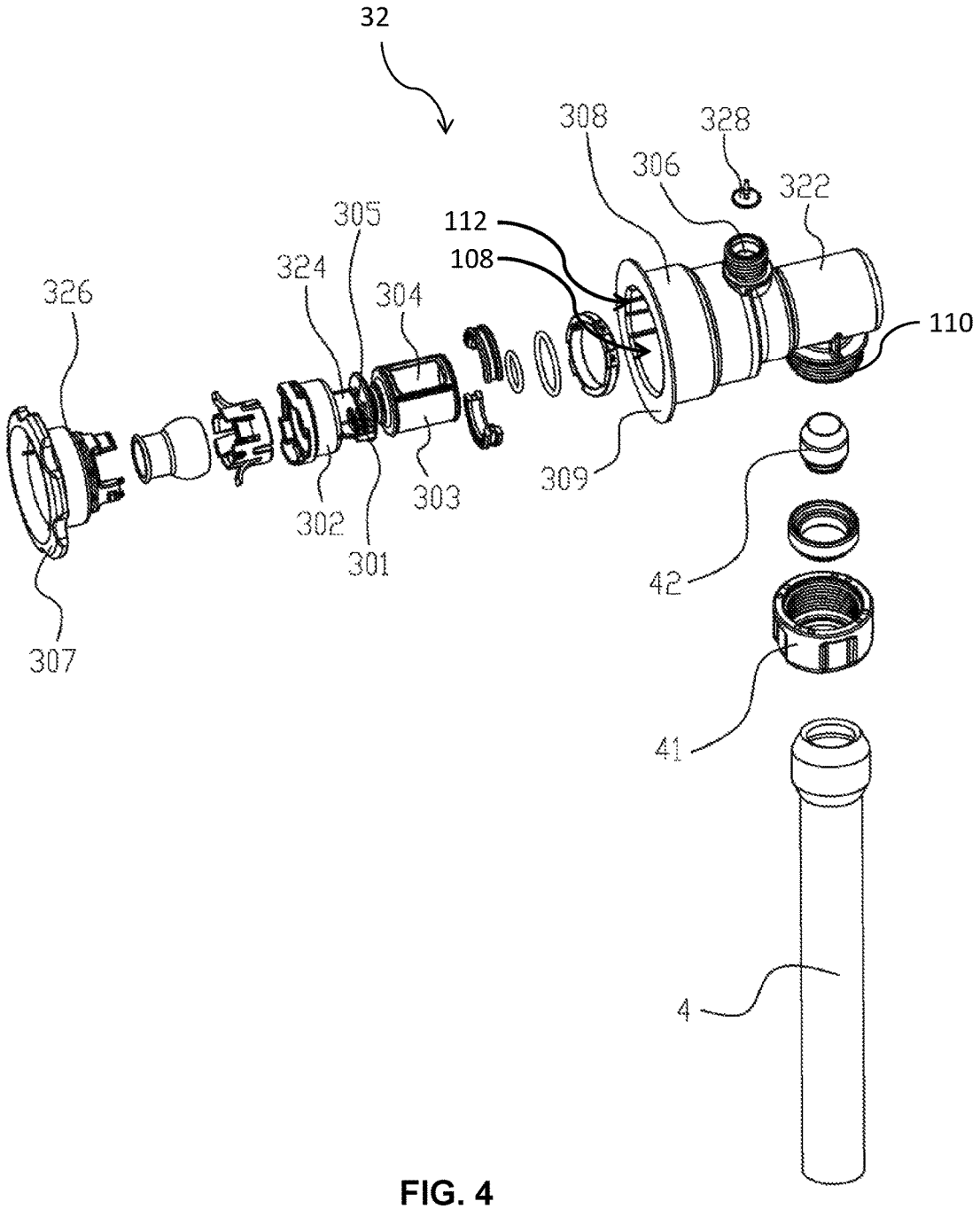
FIG. 4 is an exploded perspective view of an outlet module of the pool sprayer of FIG. 3.
Figure 5:
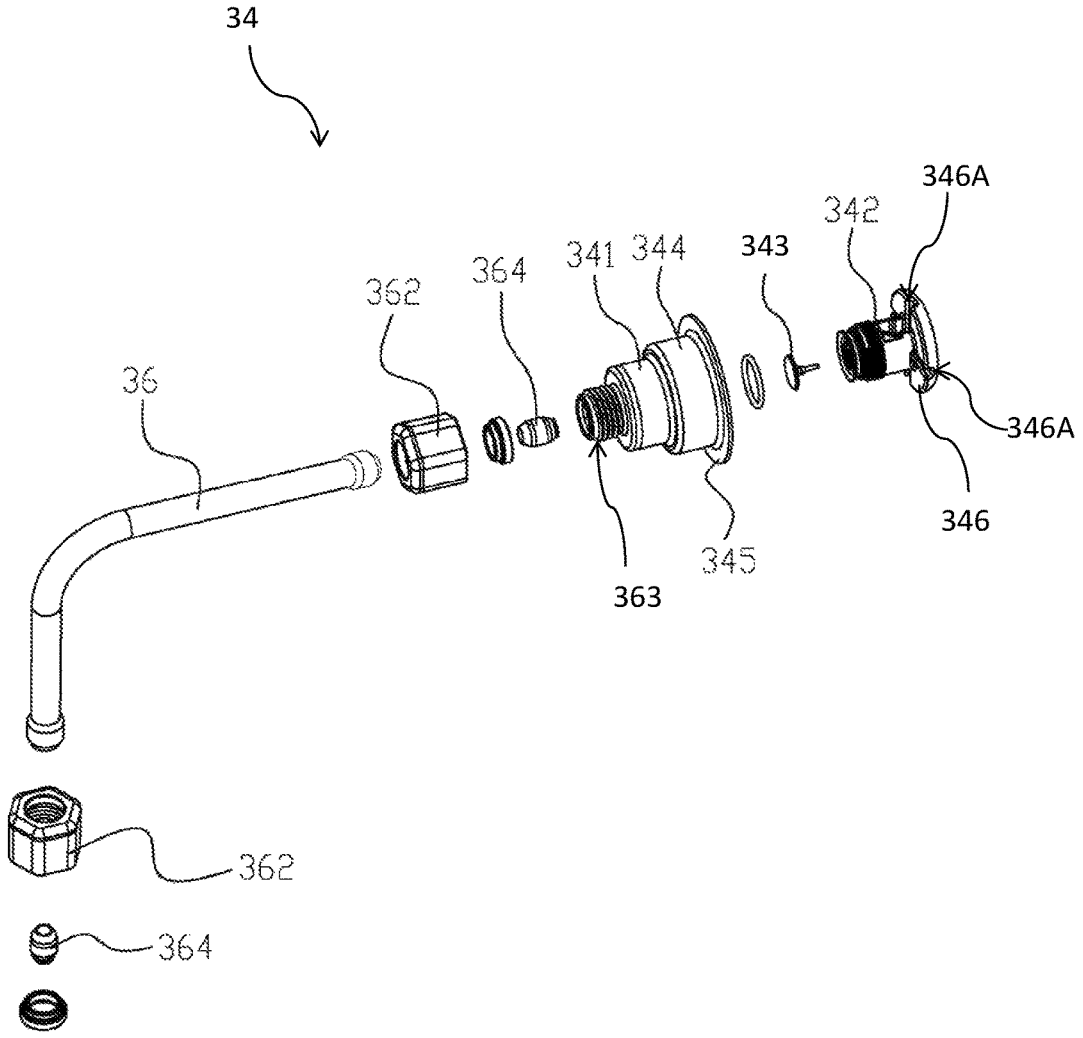
FIG. 5 is an exploded perspective view of a suction module of the pool sprayer of FIG. 3.
Figure 6:
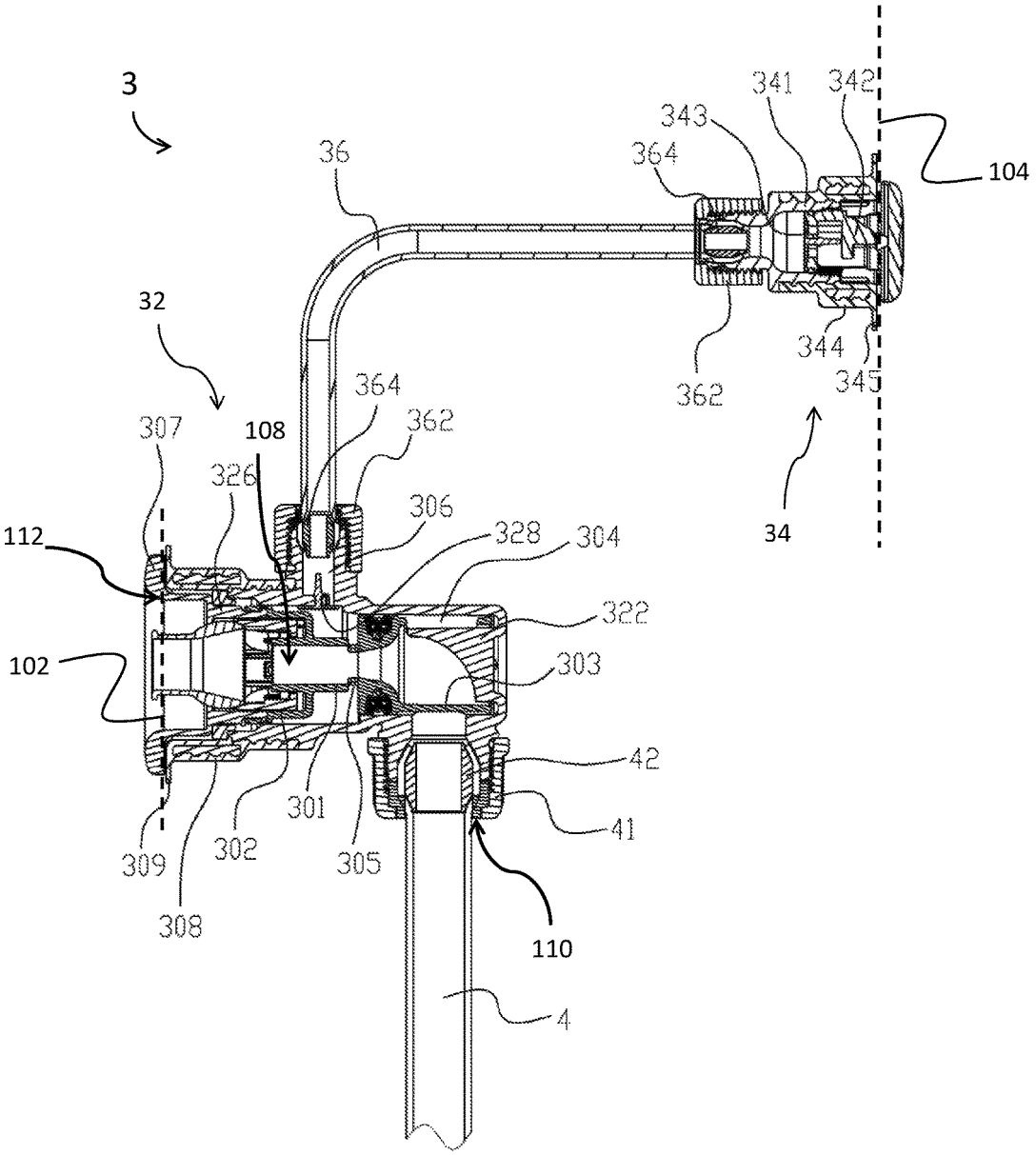
FIG. 6 is a cross-sectional elevation view of the pool sprayer of FIG. 3.

A single water sprayer 3 is shown in FIGS. 4-6 and described further below. However, the following description is also applicable to the other water sprayers 3 shown in FIGS. 1-3.

Referring to FIG. 4, outlet module 32 is coupled with pipe 4 and connecting pipe 36 (FIG. 3). Outlet module 32 includes a base body 322 having an internal passage 108 in fluid communication with three openings—a water inlet 110, an air inlet 306, and a mixed outlet 112. In the illustrative embodiment, the water inlet 110 is located near the outer end of base body 322, the mixed outlet 112 is located at the opposite inner end of base body 322, and the air inlet 306 is located therebetween.

The water inlet 110 in base body 322 is configured to receive pipe 4. In the illustrative embodiment, water inlet 110 is threaded to receive corresponding threads of nut 41 to couple pipe 4 with water inlet 110 of base body 322 as described in further detail below. In an alternate embodiment, water inlet 110 includes an alternate mechanism for coupling with pipe 4 for example, pins or clamps.

A hollow plug 42 and nut 41 facilitate coupling pipe 4 to base body 322. When plug 42 is inserted into pipe 4, the diameter of pipe 4 is enlarged. This increase in diameter provides a snug fit between pipe 4 and nut 41 that prevents pipe 4 from withdrawing out of nut 41, thereby preventing the connection between pipe 4 and water inlet 110 of base body 322 from loosening. In the illustrative embodiment, water inlet 110 is configured to be facing substantially downwards towards the ground. However, in an alternative embodiment, water inlet 110 can be configured to face any direction along the external surface of base body 322.

Air inlet 306 is also positioned along the external surface of the base body 322, and air inlet 306 is in fluid communication with both water inlet 110 and mixed outlet 112 via internal passage 108, as described below. Air inlet 306 receives connecting pipe 36 (FIG. 3), which serves to couple suction module 34 to outlet module 32 as described in further detail below. In the illustrative embodiment, air inlet 306 is threaded to couple to corresponding threads on connecting pipe 36. In an alternate embodiment, air inlet 306 includes an alternate mechanism for coupling with connecting pipe 36 for example, pins or clamps. In the illustrative embodiment, air inlet 306 is configured to be facing substantially upwards opposite the water inlet 110. However, it is contemplated that in alternative embodiments, air inlet 306 can be configured to face any direction along the external surface of base body 322.

As discussed above, internal passage 108 is defined by base body 322, and internal passage 108 enables fluid communication between air inlet 306, water inlet 110, and mixed outlet 112. In the illustrative embodiment, internal passage 108 extends substantially through length L of base body 322. In the illustrative embodiment, base body 322 is substantially cylindrical and defines internal passage 108 which is substantially cylindrical as well. However, it is contemplated that in an alternative embodiment, base body 322 may take the form of another shape such as, for example, a cube, cone, pyramid, rectangular prism, etc. It is also contemplated that internal passage 108 may take the form of another shape within base body 322 such as, for example, a cube, cone, pyramid, rectangular prism, etc.

Base body 322 further includes a soft plastic sleeve 308 with an end surface 309, both of which function to assist in receiving inner wall 102 (FIG. 6) and adjustable end cover 326. In the illustrative embodiment of FIG. 6, soft sleeve 308 is integrally formed with end surface 309 and coupled to base body 322. In an alternative embodiment, soft sleeve 308 and end surface 309 are discrete parts coupled to one another and coupled to base body 322. In a further embodiment, soft sleeve 308 and end surface 309 are integrally formed with each other and base body 322. End surface 309 of soft sleeve 308 can be welded, adhered or otherwise connected to an inner wall 102 of inflatable pool assembly 100 to create a sealing effect between outlet module 32 and inner wall 102.

Outlet module 32 further includes rotating valve spool 324 that is coupled to adjustable end cover 326 via a lock portion 302 as described in further detail below. When outlet module 32 is fully assembled, adjustable end cover 326 and rotating valve spool 324 are substantially disposed within internal passage 108. Adjustable end cover 326 includes rim 307, which forms the inner-most portion of the outlet module 32 that extends inwardly from inner wall 102 of inflatable pool assembly 100 for access by a user, as described in further detail below.

Rotating valve spool 324 is a hollow construct that includes a lock portion 302, a connecting portion 301, and an adjustable portion 303. When outlet module 32 is in its operable configuration (FIG. 6), lock portion 302 is coupled to adjustable end cover 326 such that when the user rotates the adjustable end cover 326, rotating valve spool 324 rotates as well. The rotation of rotating valve spool 324 adjusts the water flow area of internal passage 108 and the amount of water flow by controlling the alignment of gap 304 with respect to other portions of outlet module 32 as described in further detail below.

Adjustable portion 303 has a gap 304 disposed along the external surface of adjustable portion 303. The configuration of gap 304 within outlet module 32 controls the volumetric flow rate of water through outlet module 32. When gap 304 is aligned with water inlet 110 of base body 322, the volume of water flow exiting outlet module 32 is increased as water is able to move through gap 304 and internal passage 108 substantially unimpeded. By contrast, when gap 304 is only partially aligned or not aligned with water inlet 110 of base body 322, the volume of water flow through internal passage 108 and out of outlet module 32 is reduced because the solid exterior surface of the adjustable portion 303 provides a flow barrier as the water moves through internal passage 108.

Connecting portion 301 also includes one or more radial holes 305 that correspond with air inlet 306 and are disposed along the external surface of base body 322. Holes 305 and air inlet 306 communicate with suction module 34, the structure of which is described in further detail below.

Referring to FIG. 5, suction module 34 includes air inlet valve base 341, a first check valve 343, and air inlet valve cover 342. Air inlet valve base 341 defines an air passageway substantially therethrough. In the illustrative embodiment, air inlet valve base 341 is substantially conical and defines an air passageway which is substantially cylindrical. However, it is contemplated that in an alternate embodiment, air inlet valve base 341 may take the form of another shape such as, for example, a cube, cylinder, pyramid, rectangular prism, etc. It is also contemplated that the air passageway defined by air inlet valve base 341 may take the form of another shape such as, for example, a cube, cone, pyramid, rectangular prism, etc.

Air inlet valve base 341 further includes a soft plastic sleeve 344 with an end surface 345 that assists in engaging with outer wall 104 (FIG. 6). In one embodiment, soft sleeve 344 is integrally formed with end surface 345 and coupled to air inlet valve base 341. In an alternative embodiment, soft sleeve 344 and end surface 345 are discrete parts and are coupled to one another and coupled to air inlet valve base 341. In a further embodiment, soft sleeve 344 and end surface 345 are integrally formed with air inlet valve base 341. End surface 345 of soft sleeve 344 on air inlet valve base 341 can be welded, adhered, or otherwise connected to outer wall 104 of inflatable pool assembly 100 to create a sealing effect between outer wall 104 and suction module 34.

Air inlet valve base 341 has an opening 363 that is in fluid communication with the air passageway defined by air inlet valve base 341 and is coupled to connecting pipe 36. In the illustrative embodiment, opening 363 is threaded at one of its ends to engage with corresponding threads of nut 362 as described in further detail below. However, it is contemplated that in other alternative embodiments, opening 363 includes alternate mechanisms for coupling with connecting pipe 36 for example, pins or clamps.

A hollow plug 364 and nut 362 facilitate the coupling of air inlet valve base 341 to connecting pipe 36 similar to the coupling of base body 322 and pipe 4. Plug 364 is inserted into connecting pipe 36 enlarging the diameter of connecting pipe 36. The increase in diameter provides a snug fit between connecting pipe 36 and nut 362 that prevents connecting pipe 36 from withdrawing out of nut 362, thereby preventing the connection between connecting pipe 36 and opening 363 from loosening.

The other end of connecting pipe 36 is coupled to air inlet 306 of outlet module 32 (FIG. 4) using another nut 362 and hollow plug 364 similar to those described above with respect to the air inlet valve base 341.

Air inlet valve cover 342 has a distal end with a rim 346. Rim 346 of air inlet valve cover 342 is the outer-most portion of suction module 34 that extends outwardly from outer wall 104. The illustrative rim 346 defines a plurality of radial inlets 346A to permit air to enter air inlet valve cover 342 radially. When fully assembled, outer wall 104 (FIG. 6) is disposed between end surface 345 of air inlet valve base 341 and rim 346 of air inlet valve cover 342. In an alternate embodiment, air inlet valve cover 342 is substantially disposed within inflatable chamber 1 such that rim 346 of air inlet valve cover 342 is substantially in line with the thickness of outer wall 104.

First check valve 343 is disposed within the air passageway defined by air inlet valve base 341. In addition to the first check valve 343, a second check valve 328 (FIG. 4) may also be provided in air inlet 306 of base body 322 to permit the flow of air into outlet module 32 while preventing the back-flow of water into suction module 34. When sufficient suction exists in outlet module 32, check valves 328, 343 are pulled into an open configuration, and ambient air outside inflatable pool assembly 100 is pulled through rim 346, air inlet valve base 341, connecting pipe 36, and into base body 322 of outlet module 32. By contrast, when insufficient suction exists in outlet module 32, check valves 328 and 343 are in a default closed configuration, and water is prevented from back-flowing into suction module 34. Positioning the suction module 34 vertically above and radially in line with outlet module 32, as shown in FIG. 6, may also deter water from back-flowing into suction module 34.

FIG. 6 shows outlet module 32, suction module 34, and connecting pipe 36 as assembled. In operation, water is fed directly through inlet valve 2 (FIG. 2) to initially fill inner recess 106 of inflatable pool assembly 100. Once inner recess 106 is sufficiently filled with water, e.g. the water level is substantially near or above the location of rim 307, an air-water mixture may be provided from one or more pool sprayers 3 by selectively opening the corresponding adjustable end covers 326.

As water moves through outlet module 32, a negative pressure is created within base body 322. The generated negative pressure moves check valves 328, 343 from a default closed configuration (FIG. 6) to an open configuration where ambient air is then suctioned into suction module 34 by the negative pressure. The air then moves through connecting pipe 36 and enters base body 322 through holes 305 where it mixes with water flowing through internal passage 108 of outlet module 32 in base body 322 to create an air-water mixture (i.e., bubbles are created within the stream of water) that exits outlet module 32 via the mixed outlet 112.

Advantageously, the release of the air-water mixture into the inner recess 106 from each pool sprayer 3 may be controlled by the user. If the user wants the air-water mixture to be delivered with little or no force, the user can partially or entirely close each pool sprayer 3 by rotating closed the corresponding adjustable end cover 326. On the other hand, if the user wants the air-water mixture to be delivered with higher force, such as for a massaging effect, the user can open each pool sprayer 3 by rotating open the corresponding adjustable end cover 326.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An inflatable pool assembly comprising:

an inner wall defining a water cavity;

an outer wall cooperating with the inner wall to define an inflatable chamber;

a plurality of water sprayers spaced around the water cavity, each of the plurality of water sprayers comprising:

a suction module positioned at least partially within the inflatable chamber and having an air inlet positioned at the outer wall;

an outlet module positioned at least partially within the inflatable chamber and having a mixed outlet positioned at the inner wall, wherein the mixed outlet is in fluid communication with the air inlet and a water inlet;

a connecting pipe between the suction module and the outlet module; and a water inlet valve positioned within the inflatable chamber and coupled to each outlet module of the plurality of water sprayers by at least one pipe.

2. The inflatable pool assembly of claim 1, wherein the outlet module further comprises:

a base body including an internal passage coupled to the inner wall and extending into the inflatable chamber to the water inlet;

a rotating valve spool including an adjustable end portion having a gap, the rotating valve spool configured to control a volumetric flow rate of water into the internal passage based on alignment of the gap with the water inlet of the base body.

3. The inflatable pool assembly of claim 2, further comprising an adjustable end cover positioned inside the inner wall and coupled to the rotating valve spool such that rotation of the adjustable end cover drives the rotation of the rotating valve spool and alters the alignment of the gap with the water inlet of the base body.

4. The inflatable pool assembly of claim 3, wherein the rotating valve spool further includes:

a lock portion coupled to the adjustable end portion;

a connecting portion positioned between the lock portion and the adjustable end portion, the connecting portion having an external surface that includes a hole that corresponds with an air inlet of the base body.

5. The inflatable pool assembly of claim 4, wherein the hole and the air inlet of the base body communicate with the suction module.

6. The inflatable pool assembly of claim 4, wherein the connecting pipe includes a first check valve in fluid communication with the air inlet, the first check valve configured to selectively allow ambient air to be suctioned by the suction module into the base body.

7. The inflatable pool assembly of claim 6, wherein the first check valve of the outlet module opens under a negative pressure generated by a flow of liquid through the internal passage of the base body.

8. The inflatable pool assembly according to claim 4, wherein the base body includes a soft sleeve coupled to an end surface, the end surface configured to contact the inner wall of the pool assembly.

9. The inflatable pool assembly of claim 2, wherein the suction module includes:

an air inlet valve base including an air passageway extending substantially therethrough;

an air inlet valve cover coupled to the air inlet valve base; and a second check valve coupled to the air inlet valve base and positioned within the air passageway, the second check valve configured to selectively permit ambient air to be suctioned by the suction module into the connecting pipe.

10. The inflatable pool assembly of claim 9, wherein the second check valve opens under a negative pressure generated by a flow of liquid flowing through the internal passage of the base body.

11. The inflatable pool assembly of claim 10, wherein the air inlet valve base includes a soft sleeve coupled to an end surface, the end surface configured to contact the outer wall of the pool assembly.

12. An inflatable pool assembly comprising:

an inner wall defining a water cavity;

an outer wall opposite said inner wall to define a space between the outer wall and the inner wall, the outer wall cooperating with the inner wall to define an inflatable chamber;

a plurality of water sprayers, each of the plurality of water sprayers comprising:

an outlet module positioned at least partially within the inflatable chamber and having a mixed outlet positioned at the inner wall, the mixed outlet is in fluid communication with an air inlet and a water inlet; and a suction module positioned vertically above the outlet module and at least partially within the inflatable chamber, the suction module having the air inlet positioned at the outer wall;

wherein the suction module includes:

an air inlet valve cover having a rim;

an air inlet valve base having an end surface;

the outer wall positioned between the rim and the end surface; and a connecting pipe between the suction module and the outlet module.

13. The inflatable pool assembly of claim 12, wherein the suction module is radially in line with the outlet module.

14. The inflatable pool assembly of claim 12, wherein the connecting pipe is L-shaped.

15. The inflatable pool assembly of claim 12, wherein the outlet module includes:

an adjustable end cover having a rim;

a base body having an end surface; and wherein the inner wall is positioned between the adjustable end cover and the end surface.

16. The inflatable pool assembly of claim 15, further comprising:

a rotating valve spool including an adjustable end portion having a gap, the rotating valve spool coupled to the adjustable end cover such that rotation of the adjustable end cover drives the rotation of the rotating valve spool.

17. The inflatable pool assembly of claim 16, wherein the rim of the outlet module is rotatable, the rotation of the rim drives the rotation of the rotating valve spool and alters the alignment of the gap with the water inlet of the base body.

18. A method of manufacturing an inflatable pool assembly comprising:

coupling an inner wall to an outer wall to define an inflatable chamber;

coupling a portion of each of a plurality of suction modules to the outer wall, each suction module positioned at least partially within the inflatable chamber;

coupling a portion of each of a plurality of outlet modules to the inner wall, each outlet module positioned at least partially within the inflatable chamber;

coupling each outlet module and a respective suction module together by a connecting pipe;

positioning a water inlet valve within the inflatable chamber; and coupling the water inlet valve to each of the plurality of outlet modules by at least one pipe.

19. The method of claim 18, wherein coupling a portion of each outlet module to the inner wall further includes attaching an end surface of a base body and a rim of an adjustable end cover to the inner wall such that the inner wall is positioned between the rim and the end surface.

20. The method of claim 18, wherein coupling a portion of each suction module to the outer wall further includes attaching an end surface of an air inlet valve base and a rim of an air inlet valve cover to the outer wall such that the outer wall is positioned between the rim and the end surface.

* * * * *